US008276414B2

(12) United States Patent
Luo

(10) Patent No.: US 8,276,414 B2
(45) Date of Patent: Oct. 2, 2012

(54) MICROPOWER PASSIVE ELECTRONIC LOCK CYLINDER

(76) Inventor: Shifu Luo, Guangdong (CN)

( * ) Notice: Subject to any disclaimer, the term of this patent is extended or adjusted under 35 U.S.C. 154(b) by 0 days.

(21) Appl. No.: 12/953,760

(22) Filed: Nov. 24, 2010

(65) Prior Publication Data

US 2011/0067465 A1 Mar. 24, 2011

Related U.S. Application Data

(63) Continuation-in-part of application No. PCT/CN2008/072218, filed on Sep. 1, 2008.

(30) Foreign Application Priority Data

May 28, 2008 (CN) ..... 2008 1 0109826

(51) Int. Cl.
*E05B 49/00* (2006.01)

(52) U.S. Cl. ..... 70/278.7; 70/283; 70/283.1; 70/256; 70/257; 70/278.1; 70/278.2; 70/278.3

(58) Field of Classification Search ..... 70/278.1–278.3, 70/278.7, 283, 283.1, 386, 256, 257
See application file for complete search history.

(56) References Cited

U.S. PATENT DOCUMENTS

| | | | | |
|---|---|---|---|---|
| 5,791,177 | A * | 8/1998 | Bianco | 70/283.1 |
| 5,823,030 | A | 10/1998 | Theriault et al. | |
| 5,839,305 | A * | 11/1998 | Aston | 70/283.1 |
| 6,125,673 | A * | 10/2000 | Luker | 70/283.1 |
| 6,155,089 | A | 12/2000 | Hurskainen et al. | |
| 6,374,653 | B1 * | 4/2002 | Gokcebay et al. | 70/278.3 |
| 6,615,625 | B2 | 9/2003 | Davis | |
| 6,840,072 | B2 * | 1/2005 | Russell et al. | 70/278.3 |
| 6,895,792 | B2 * | 5/2005 | Davis | 70/278.3 |
| 7,958,758 | B2 * | 6/2011 | Trempala et al. | 70/283.1 |
| 2003/0140667 | A1 * | 7/2003 | Davis | 70/278.3 |
| 2007/0044523 | A1 * | 3/2007 | Davis | 70/278.7 |

FOREIGN PATENT DOCUMENTS

| | | | |
|---|---|---|---|
| CN | 1396979 | A | 2/2003 |
| CN | 1570335 | A | 1/2005 |

OTHER PUBLICATIONS

International Search Report for PCT/CN2008/072218.

* cited by examiner

*Primary Examiner* — Suzanne Barrett
*Assistant Examiner* — David E Sosnowski
(74) *Attorney, Agent, or Firm* — Caesar, Rivise, Bernstein, Cohen & Pokotilow, Ltd.

(57) ABSTRACT

A micropower passive electronic lock cylinder including an immovable cylinder body (3), a rotatable plug (1), and an electronic control circuit part is described. An electronic control circuit board (13) electrically connected with a micromotor (14) and locating switches (15, 16) is arranged in the rotatable plug (1). A lock pin (8), which is controlled by a displacement limiting cam (5) driven by the micromotor (14), moves between the immovable cylinder body (3) and the rotatable plug (1) to release or block the rotatable plug (1).

11 Claims, 10 Drawing Sheets

MICROPOWER PASSIVE ELECTRONIC LOCK CYLINDER

TECHNICAL FIELD

The invention relates to the field of electronic locks.

BACKGROUND

An electronic lock using commercial power or batteries, which is directly connected with the circuit in the lock body to supply power, is called an "active electronic lock". Traditional active electronic locks (adopting IC card, ID card, fingerprint identification and the like) that are widely used at present need 4 to 6 pieces of batteries of size AA or LR6, and the service life of the batteries is usually 3 to 12 months. Therefore, the active electronic lock not only consumes a large number of batteries, but also requires more maintenance work, such as frequent inspection, battery replacement and the like. Furthermore, the batteries may be in loose contact such that electronic elements and devices become aged from being energized for long, influencing the reliability and service life of the active electronic lock. On the other hand, electronic locks making use of commercial power for power supply have disadvantages of a limited application range, high power consumption in standby state all the year round, inconvenient installation, increased maintenance, and adverse effects on protection of the environment.

In 1999, the patent ZL 99203695.X Key to Electronic Lock disclosed a technical solution of a basic active "key to electronic lock". The key comprises an IC chip for producing an unlocking password, and the working batteries of an electronic lock are further arranged in the electronic key. Based on this patented technology, the applicant combined the patented technological packages ZL 99207205.0 Electronic Locating Device of Electric Controlled Lock and ZL 99202022.0 Trip Device of Electric Lock (with a WIPO patent number of WO 0042278, an American patent number of U.S. Pat. No. 6,502,870, an European patent number of EP 1 167 663 and an Australian patent number of AU 752034B), and developed a series of low-power passive electronic locks using the active key to electronic lock. The passive electronic lock has the advantages of easy installation, easy use, low power consumption, protection of the environment, better reliability and much longer service life than that of the active electronic lock. However, the above-mentioned patented technological packages cannot be used for to develop a passive electronic lock cylinder that is as small as a common mechanical lock cylinder to directly substitute or replace the mechanical lock cylinder.

In 2000, American U.S. Pat. No. 6,615,625 Electronic Locking System, with Chinese patent numbers of ZL 01804076.4 and ZL 200710108769.5, disclosed a passive electronic lock cylinder which used the technology of an active key to electronic lock and was of comparative size to that of the common mechanical lock cylinder, and this passive electronic lock cylinder was made commercially available.

However, the locking system of American U.S. Pat. No. 6,615,625 has the following disadvantages:

1. The passive electronic lock cylinder uses a linear solenoid as an executive element, and the plunger (a displacement limiting armature for locking and unlocking) of the linear solenoid does not have locating and self-locking functions after power-off (namely that the plunger is automatically restored by a compression spring as soon as power is switched off). The linear electromagnetic solenoid must therefore be energized to attract the plunger. The power-on time for unlocking (namely the waiting time for rotating a lock plug to a specified angle via the key) is about 1 second; resulting in increased electric energy being consumed during this time, and the electromechanical conversion efficiency of the passive electronic lock cylinder is low. A battery with relatively large volume and capacity must be installed in the active electronic key to provide for extended use over time, making the size of the active electronic key relatively large.

2. The plunger does not have a self-locking function after power-off, so that the rotation angle of the lock plug cannot be more than 360 degrees (by comparison the lock plug of a common lock cylinder for an anti-theft door is required to rotate more than 720 degrees). If the lock plug is required to rotate several times, it consumes substantially more electric energy, decreasing the usefulness and commercial viability of the lock.

3. The microcontroller unit (MCU) in the electronic control circuit of the lock plug cannot distinguish between the dynamic and static mechanical positions of the pin and plunger in the lock plug, and therefore cannot distinguish between the locking and unlocking states of the lock cylinder. Therefore, the passive electronic lock cylinder cannot be adapted to perform remote monitoring functions and the like, or functions requiring higher intellectualization and higher safety through wired/wireless networks.

In 2004, patent ZL 200410037420.3 Intellectual Passive Electronic Lock Cylinder disclosed a passive electronic lock cylinder adopting the technology of the active key to electronic lock. The cylinder of the intellectual passive electronic lock disclosed has the disadvantages of: being unable to distinguish between the dynamic and static positions of mechanical actuating elements due to the adoption of the linear electromagnetic solenoid (electromagnet) as an executive element. Furthermore, the intellectual passive electronic lock cylinder also has the three disadvantages of the patent ZL 01804076.4; in that there is no disclosure of measures taken to prevent unexpected unlocking caused by the impact of external force, so that when exerting an impact force on the lock cylinder, a driving rack will move axially, under inertia engaging with a driven rack. Thus, the intellectual passive electronic lock cylinder described can easily be unlocked by hitting with a hammer or a weight.

SUMMARY OF THE INVENTION

The purpose of the invention is to provide a micropower passive electronic lock cylinder which can overcome the disadvantages of the prior art, namely a micropower passive electronic lock cylinder with the advantages of higher electromechanical conversion efficiency, lower power consumption, arbitrary and multi-circle rotation of the lock plug, impact resistance, commercial viability, high safety and protection of the environment so act as a substitute and replace or upgrade a mechanical lock cylinder of a traditional mechanical lock.

The invention relates to a micropower passive electronic lock cylinder which comprises an immovable cylinder body, a rotatable plug, and an electronic control part or the like. An electronic control circuit board 13, a micromotor 14, a first locating switch 15, a second locating switch 16, a displacement limiting cam 5 and a lock pin 8 are arranged in the rotatable plug 1. The micromotor 14, the first locating switch 15 and the second locating switch 16 are electrically connected with the electronic control circuit board 13. The first locating switch 15 and the second locating switch 16 are respectively arranged beside the lock pin 8 and the displacement limiting cam 5 and provide switching information upon movement of the lock pin 8 and the displacement limiting cam 5. The displacement limiting cam 5 is arranged on the output shaft of the micromotor 14. When locked, the lock pin 8 is limited by the convex surface 5*c* (namely the position with maximum diameter) of the displacement limiting cam 5 so that the lock pin 8 cannot move along an axial direction, and the lock pin 8 is held between the rotatable plug and the immovable cylinder body, preventing the relative rotation between them.

After the electronic control circuit board 13 provides an unlocking instruction, the concave surface 5*b* of the displacement limiting cam 5 rotates to the position opposite to the lock pin 8, and the lock pin 8 moves along an axial direction following the rotation of the rotatable plug, so the lock pin 8 is released from between the immovable cylinder body and the rotatable plug, and the rotatable plug can rotate relative to the immovable cylinder body and unlock the lock. A marked position of the displacement limiting cam 5 driven by a stepping micromotor 14 is provided with light-reflecting surfaces 5*a*. When a light-reflecting surface 5*a* is opposite to the photoelectric reflecting type second locating switch 16, the information of the marked position can be obtained. The information of the marked position can also be obtained by replacing the light-reflecting surface 5*a* with a permanent magnet or salient point to drive the magnetic-control or electromechanical locating switch. The information is processed by the electronic control circuit board 13 to determine the rotation angle of the driven displacement limiting cam 5. When the displacement limiting cam 5 rotates 90 degrees, the lock pin 8 can be held or released to move along an axial direction, to lock or unlock the lock cylinder. The arm rod 8*a* on the lock pin 8 drives the first locating switch 15 to provide the position information of the lock pin 8 moving along an axial direction, and the information is processed by the electronic control circuit board 13 so as to detect whether the electronic lock plug has been released.

Advantages and Effects:

1. A stepping micromotor or a rotary solenoid (also known as rotary electromagnet, whose basic operating principle is equivalent to that of the stepping micromotor but has simpler structure) is used as an executive element to drive an unloaded displacement limiting cam. The electromechanical conversion efficiency of this technical solution is much higher than that of the technical solution using a linear solenoid to drive a loaded (compression spring) plunger, and the driving current is smaller. The power-on time for locking or unlocking occurs in tens of milliseconds, so that the operating power consumption is lower than that of a lock using a linear solenoid by more than one order of magnitude. This means that when using a battery with the same capacity, the number of unlocking cycles (and thus battery life) of the micropower passive electronic lock cylinder is significantly greater than that of a lock cylinder adopting a linear solenoid, and the power consumption for locking and unlocking is relatively low. Therefore, batteries of smaller volume and capacity can be used for the micropower passive electronic lock cylinder so as to adapt to the modern trends of economy, small size, light weight, small thickness and protection of the environment.

2. The displacement limiting cam on the shaft of the micromotor has automatic identifying, locating and self-locking functions, so the position of the displacement limiting cam cannot be changed after power-off, and the lock plug can rotate arbitrarily for several circles without any power consumption.

3. The micropower passive electronic lock cylinder does not comprise a part equivalent to a linear solenoid plunger which can move axially under inertia. Therefore, the lock cylinder cannot be mistakenly unlocked under an impact force from any direction.

4. The microcontroller unit in the electronic lock plug can detect the dynamic and static positions of the displacement limiting cam and the lock pin, relative to the surrounding environment. Therefore, the invention provides a new electronic lock cylinder which can be adapted for connection to a wired/wireless communication network for functions of real-time remote monitoring and the like, thereby broadening the application range of the invention.

5. The electronic lock plug has the advantages of high commercial viability, easy size standardization, fewer mechanical parts and components, compact structure and small size, and can be easily fitted into various traditional immovable cylinder bodies of various external dimensions to produce an independent passive electronic lock cylinder. The invention can be used to directly substitute, replace or upgrade a mechanical lock cylinder of a traditional mechanical lock, and form serial products of passive electronic locks.

The invention accordingly provides a micropower passive electronic lock cylinder, comprising an immovable cylinder body, a rotatable plug and an electronic control circuit part, characterized in that an electronic control circuit board and a micromotor or a rotary solenoid electrically connected with the electronic control circuit board are arranged in the rotatable plug; the micromotor or rotary solenoid drives a displacement limiting cam to rotate; the electronic control circuit gives relevant instructions to make the displacement limiting cam rotate to the position in which the lock pin is limited or released, and thus the locking or unlocking state of the rotatable plug is controlled.

DETAILED DESCRIPTION

The invention will further be described with reference to the figures and specific embodiments.

Figure 1:
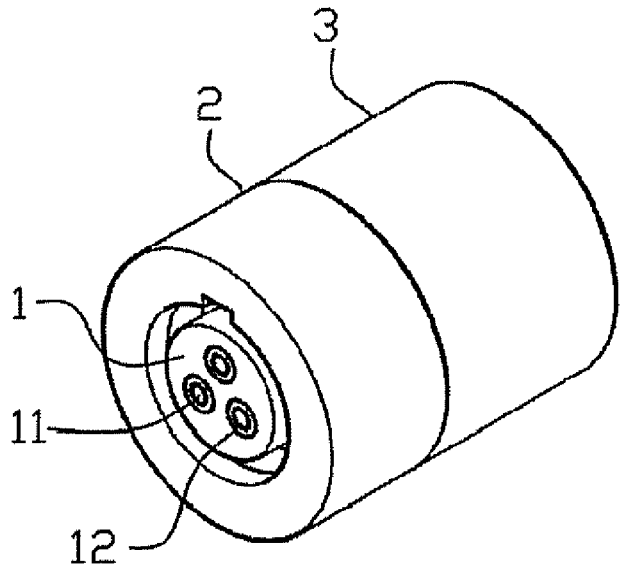
FIG. 1 shows a perspective view of the lock cylinder.

FIG. 1 shows a perspective view of the lock cylinder in which a typical cylindrical electronic lock cylinder comprises a rotatable plug 1, a front cover 2 and a cylinder body 3, wherein the front cover 2 and the cylinder body 3 can be assembled by processes such as interference fit, cohering, soldering, and the like. Three contact electrodes 11 and an insulating bush 12 are located in the rotatable plug 1. When the lock cylinder is matched with different types of mechanical locks, the shape and structure of the front cover and the cylinder body can be correspondingly adapted. The front cover and the cylinder body can thus be adapted to fit various types of mechanical locks, and fitted in similar fashion to that of common traditional mechanical lock cylinders.

Figure 2:
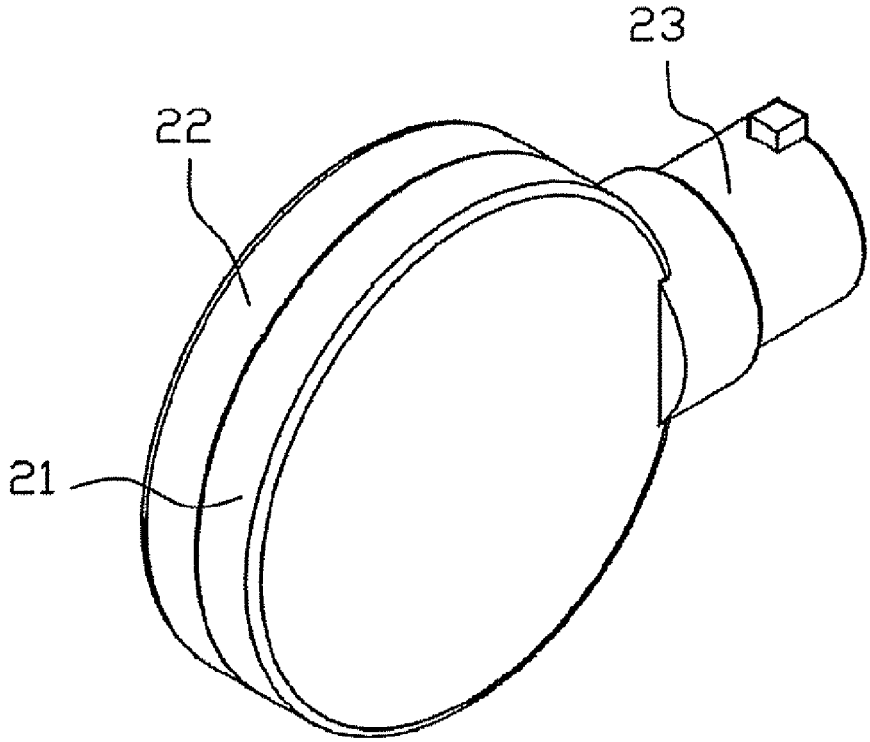
FIG. 2 shows a perspective view of the key.

FIG. 2 shows the perspective view of the key in which the outward appearance of an electronic key is formed by combining a cover 21, a bottom case 22 and a sleeve 23.

Figure 3:
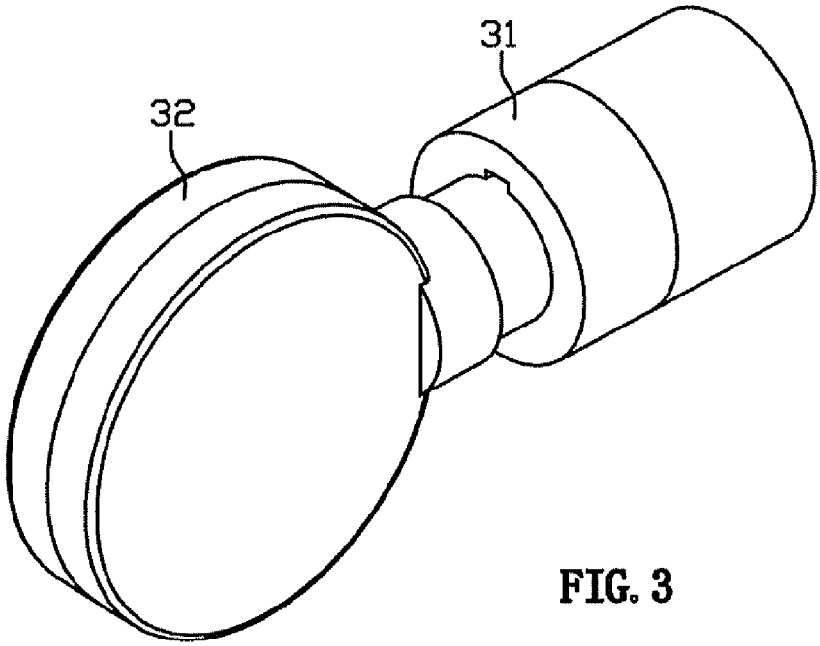
FIG. 3 shows a perspective view of the key inserted in the lock cylinder.

FIG. 3 shows a perspective view of the key inserted in the lock cylinder, in which the electronic key 32 is inserted in the electronic lock cylinder 31 in adaptive relationship similar to that between a common mechanical cylindrical lock and its key.

Figure 4:
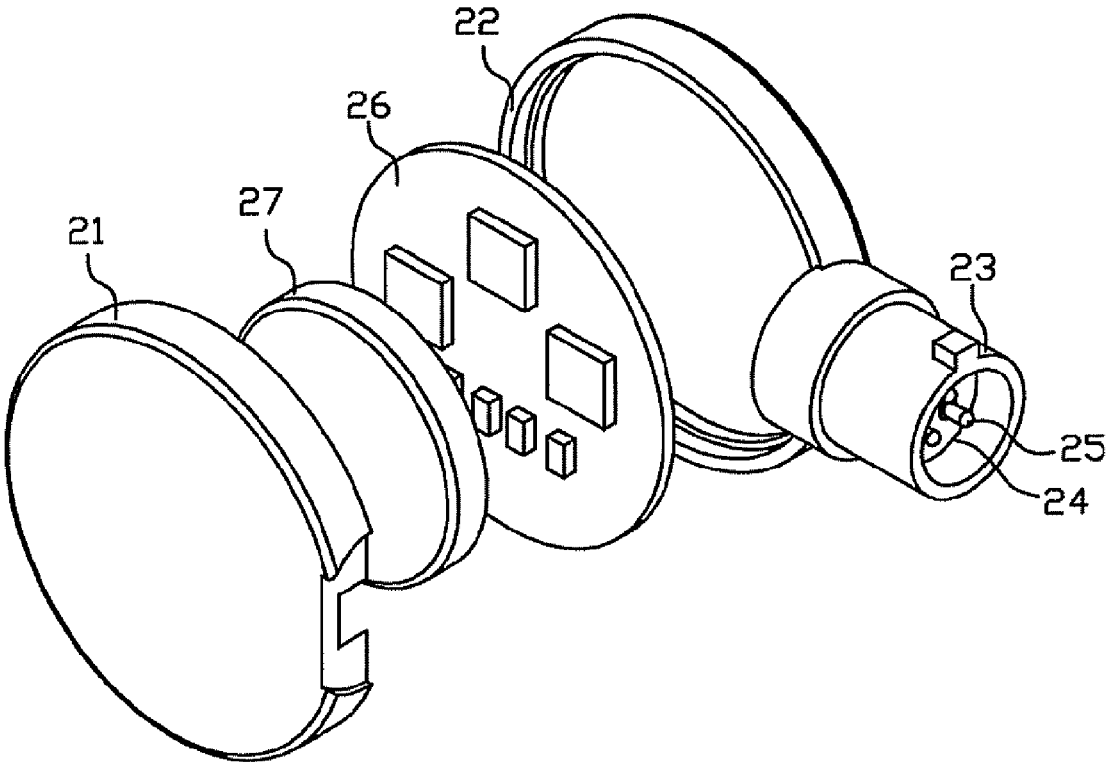
FIG. 4 shows a perspective view of the key (disassembled)

FIG. 4 shows a perspective view of the key (disassembled) in which the sleeve 23 is located in the bottom case 22, three elastic electrodes 25 are isolated by insulators 24 and located in the sleeve 23, and an electronic control circuit board 26 and a battery 27 are arranged in the bottom case and closed by the cover 21 to form a unit.

Figure 5:
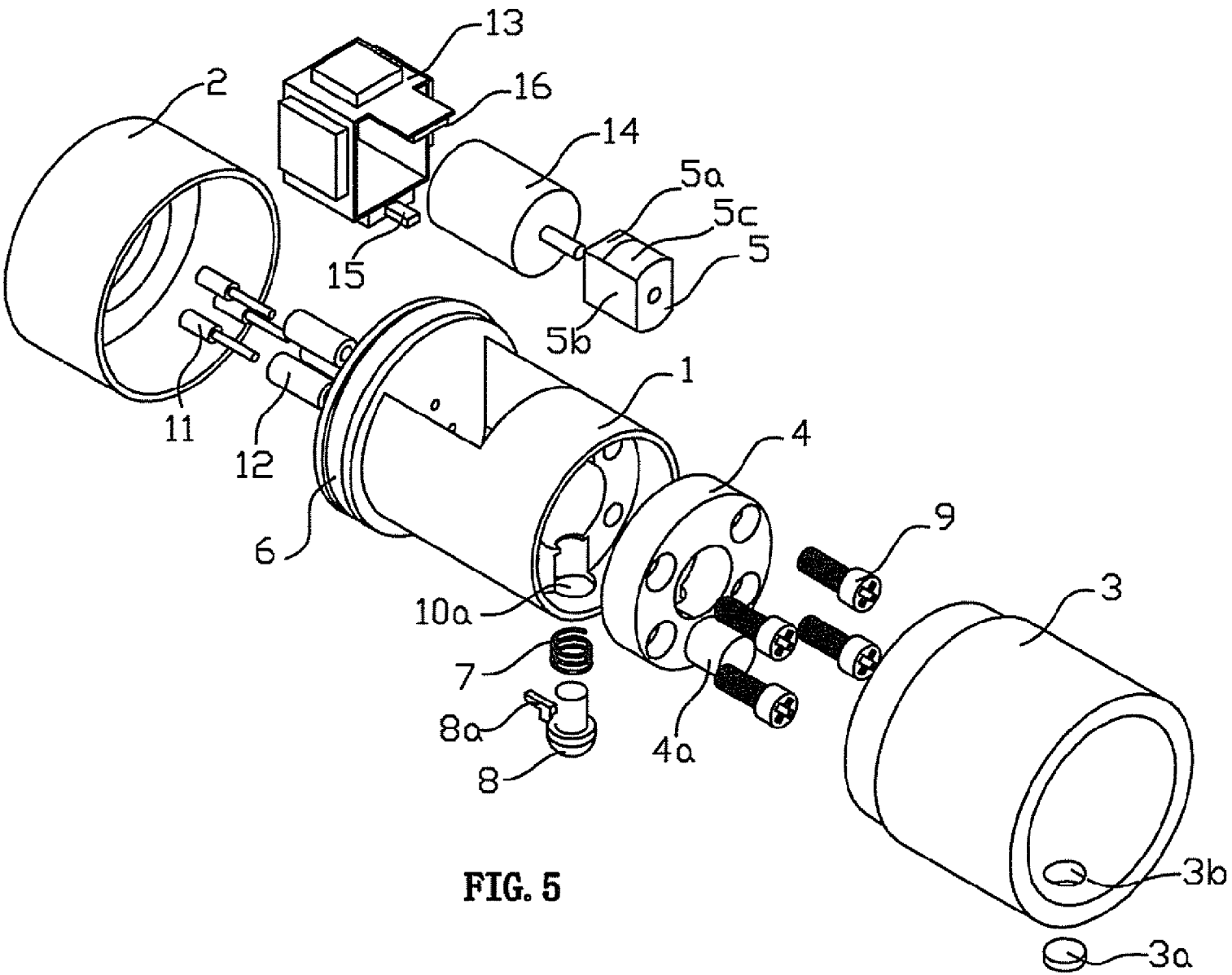
FIG. 5 shows a perspective view of Embodiment I of the lock cylinder (disassembled)

FIG. 5 shows a perspective view of Embodiment I of the lock cylinder (disassembled). After the electronic cylinder is disassembled, the relative perspective positions of the front cover 2, the cylinder body 3, the rotatable plug 1, an end cover 4 and other components can be clearly seen. A bendable flexible electronic control circuit board 13 is provided with a first locating switch 15, a second locating switch 16 and other electronic elements and devices. Three contact electrodes 11 are located in the rotatable plug 1 after passing through an insulating bush 12, and a compression spring 7. A lock pin 8 with an arm rod 8*a* is arranged in a guide hole 10*a*. A displacement limiting cam 5 is arranged on the shaft of a micromotor 14 having light-reflecting surfaces 5*a*, convex surfaces 5*c* and concave surfaces 5*b*. The end cover 4 is integratable with the rotatable plug 1 through fasteners 9. An eccentric column 4*a* on the end cover 4 is useful as an interface for contacting other linking mechanical components on a complement lock. A locating hole 3*b* in the cylinder body 3 is also useful as a displacement limiting hole of the lock pin 8. A closing cover 3*a* seals off the locating hole 3*b*. A waterproof dust-free seal ring 6 is located in the front-end groove of the rotatable plug 1.

Figure 6:
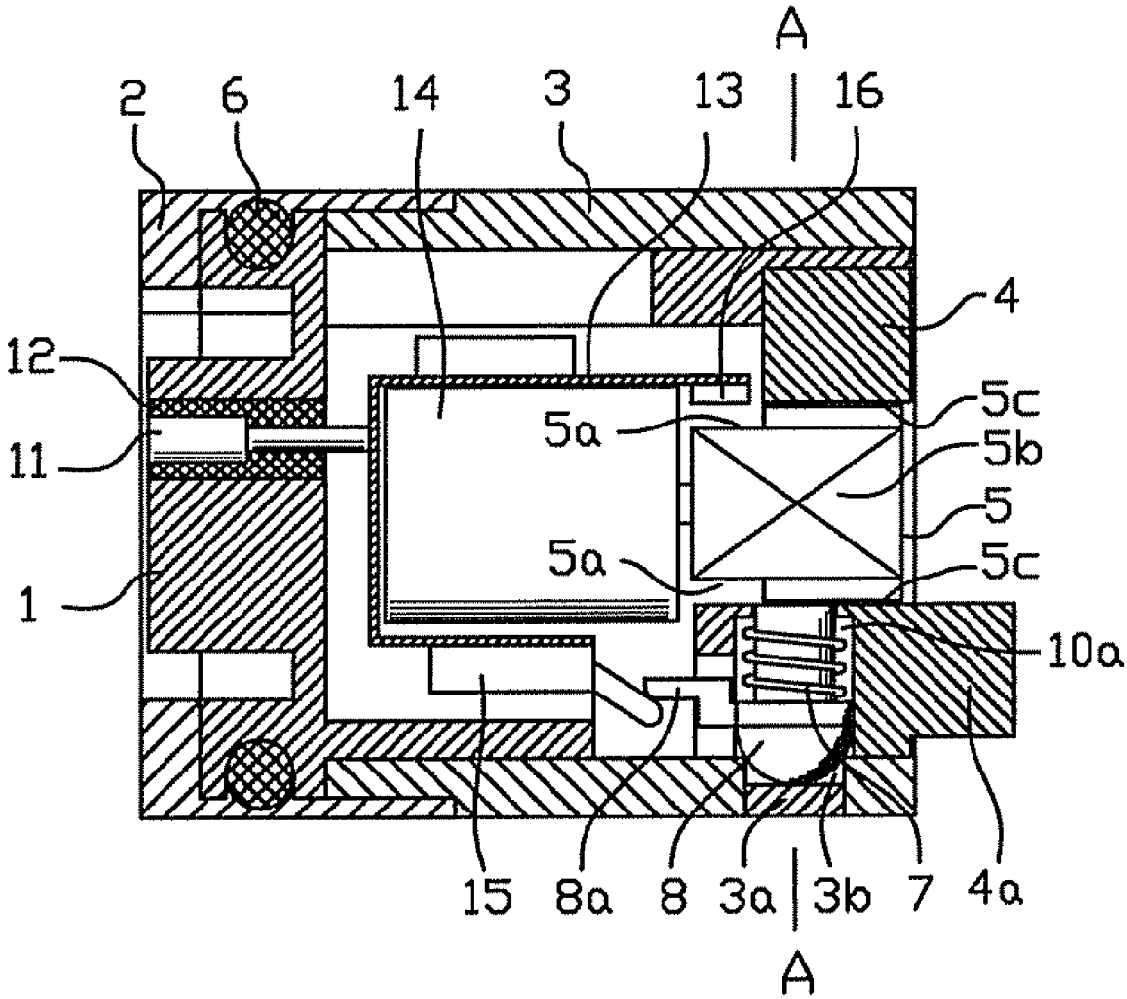
FIG. 6 shows a sectional view of Embodiment I of the lock cylinder (assembled)
Figure 14:
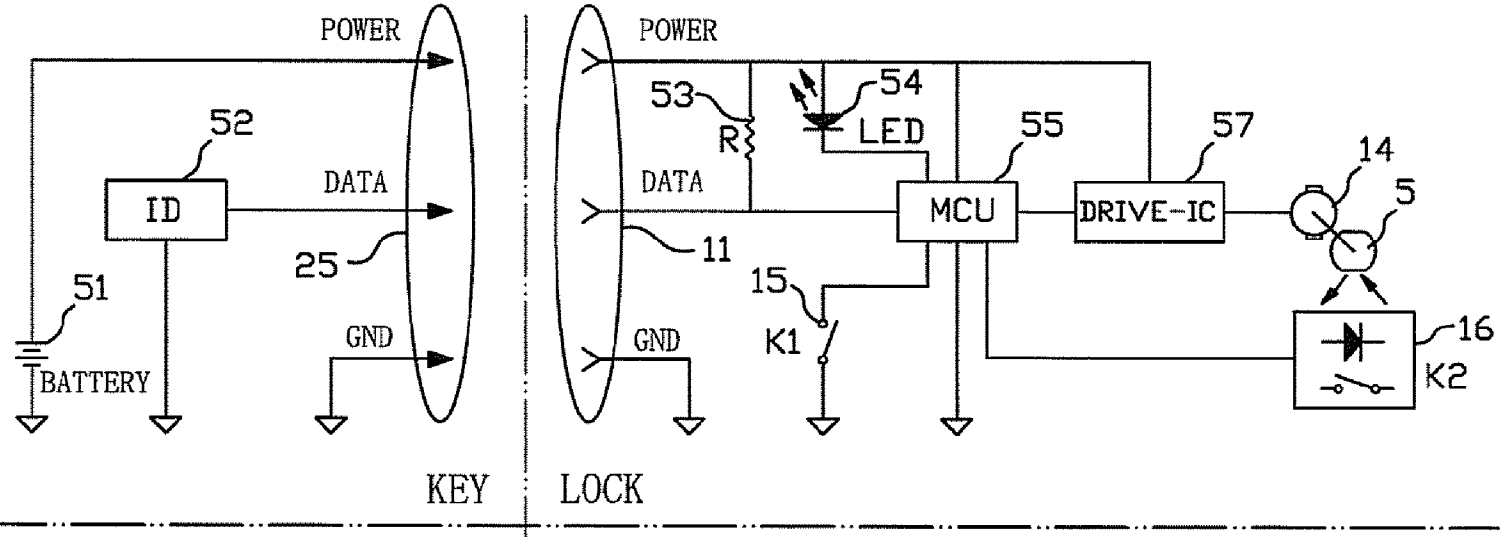
FIG. 14 shows a circuit block diagram of a basic key and a lock cylinder.

FIG. 6 shows a section view of Embodiment I of the lock cylinder (assembled) in which it shows the assembling positions of all electronic and mechanical parts and components which comprise the front cover 2, the cylinder body 3, the rotatable plug 1, the end cover 4 and the like, and the flexible electronic control circuit board 13 are arranged in the cavity of the rotatable plug 1 which is provided with the first locating switch 15, the second locating switch 16 and other electronic elements and devices. Three contact electrodes 11 located in the front end of the rotatable plug 1 are electrically connected with the electronic control circuit board 13 after passing through the insulating bush 12, and the micromotor 14 is arranged in the central space of the electronic control circuit board 13. The compression spring 7 and the lock pin 8 are arranged in the guide hole 10*a*, and the first locating switch 15 is driven by the arm rod 8*a* on the lock pin 8. The displacement limiting cam 5 driven by the micromotor 14 can freely rotate in the end cover 4. Two light-reflecting surfaces 5*a* located in the marked positions on the surfaces of the displacement limiting cam 5 oppose the photoelectric reflecting type second locating switch 16 so as to control the rotation angle of the displacement limiting cam 5 after identification of an electronic control circuit. Each time the displacement limiting cam 5 rotates 90 degrees, the convex surfaces 5*c* and the concave surfaces 5*b* alternately appear to hold or release the lock pin 8, further inhibiting or permitting the rotation of the electronic lock plug, thereby unlocking or locking the lock. The micromotor 14 of Embodiment I is of stepping type, and therefore, the rotation angle of the micromotor can be accurately controlled by the electronic control circuit. A switching signal obtained by the second locating switch 16 is used for identifying two orthogonal positions of the displacement limiting cam 5, namely the light-reflecting surfaces 5*a* so as to prevent the displacement limiting cam 5 from being detained in an undesirable non-orthogonal position due to the stepping micromotor not being synchronized therewith, and to correct the displacement limiting cam 5 to the synchronous orthogonal position during the next rotation. The second locating switch 16 plays an important role in detecting the starting point or halting point of the displacement limiting cam 5 during rotation. The first locating switch 15 synchronously actuates the lock pin 8, causing a switching signal relating to the position of the lock pin 8 to be produced so that the control circuit can detect whether the lock plug is unlocked by rotating or is in a locking or to-be-locked state. The relationship between the sum and difference of the signals of the first locating switch 15 and the second locating switch 16 can be used to obtain further information relating to the state of the lock cylinder. The information can be processed by the electronic control circuit (see to FIG. 14 and written description). The relative positions of the waterproof dust-free seal ring 6, the closing cover 3*a*, the locating hole 3*b* and the eccentric column 4*a* are also shown in FIG. 14.

Figure 7:
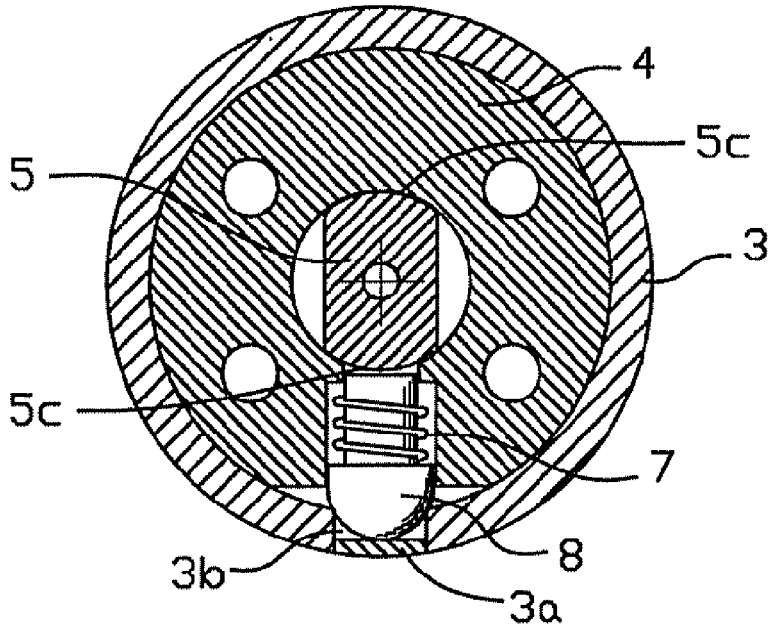
FIG. 7 shows Embodiment I of the lock cylinder in the locking state (namely the A-A section view of the cylinder in FIG. 6)

FIG. 7 shows Embodiment I of the lock cylinder in the locking state (namely the A-A section view of the cylinder in FIG. 6) in which the lock cylinder is in the locking state, and the relative positions of the following mechanical parts and components are shown: the cylinder body 3, the end cover 4, the displacement limiting cam 5, the lock pin 8, the compression spring 7 and the closing cover 3*a*. When locked, the compression spring 7 acts on the lock pin 8, a part of the spherical surface of the lock pin 8 then projects into locating hole 3*b*, and the lock pin 8 is abuts the convex surface 5*c* of the displacement limiting cam 5, preventing movement along an axial direction. The spherical surface of the lock pin 8, when the pin 8 is located between the rotatable plug and the immovable cylinder body, prevents the relative rotation therebetween.

Figure 8:
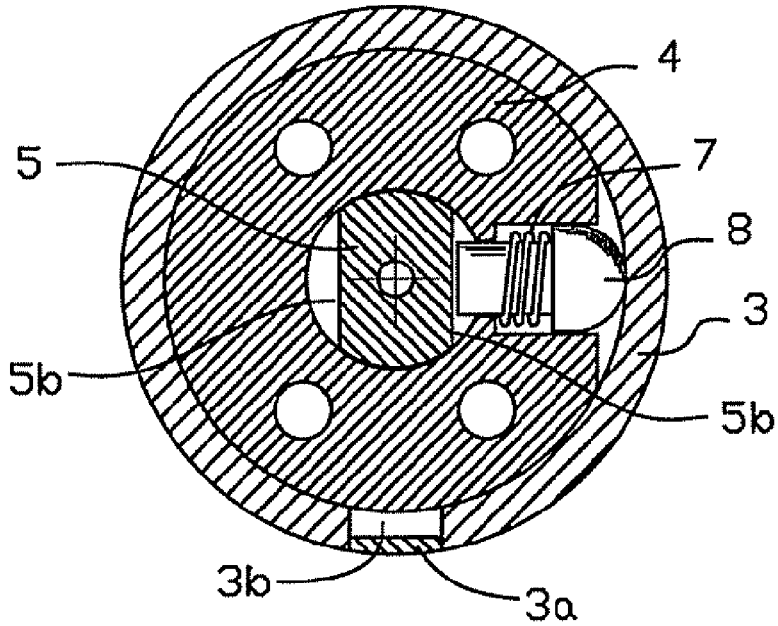
FIG. 8 shows Embodiment I of the lock cylinder in the unlocking state (namely the A-A section view of the cylinder in FIG. 6)

FIG. 8 shows Embodiment I of the lock cylinder in the unlocked state (namely the A-A section view of the cylinder in FIG. 6). After the lock plug is rotated by 90 degrees, the relative positions of the following relevant mechanical parts and components are shown: the immovable cylinder body 3, the end cover 4, the displacement limiting cam 5, the lock pin 8, the compression spring 7 and the closing cover 3*a*, the displacement limiting cam 5 shown in FIG. 8 is rotated by 90 degrees through the micromotor relative to that shown in FIG. 7, and the concave surface 5*b* is rotated to be located opposite to the lock pin 8. When the lock plug 8 is rotated, it leaves the locating hole 3*b* and moves along an axial direction from between the rotatable plug 1 and the immovable cylinder body 3, which are then freely rotatable with respect to one another.

Figure 9:
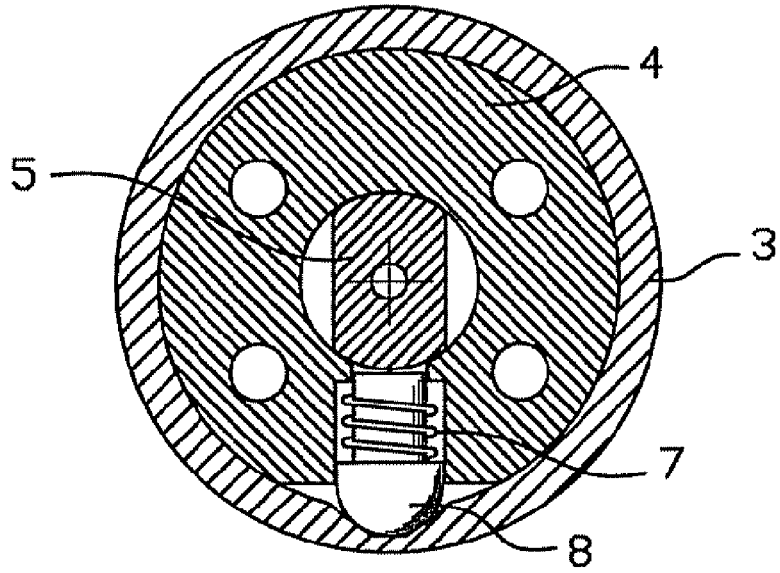
FIG. 9 shows Embodiment I of the lock cylinder in the locking state (the A-A section view of Embodiment II)
Figure 10:
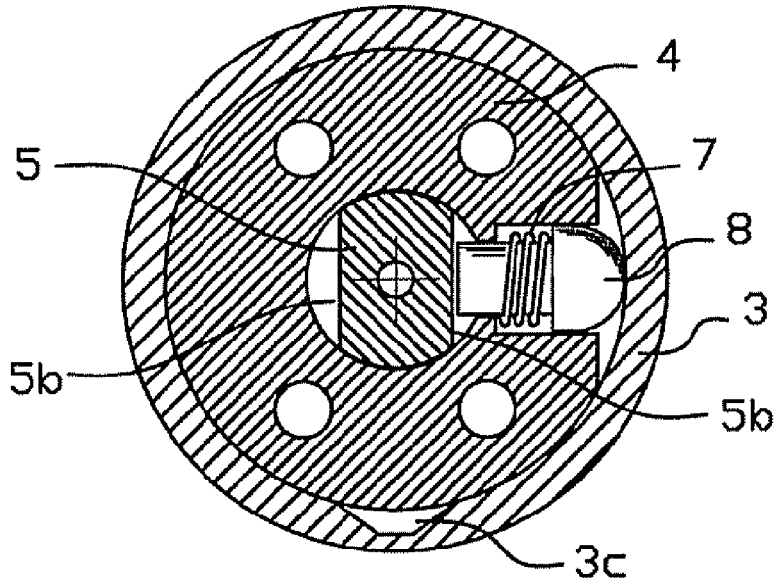
FIG. 10 shows Embodiment I of the lock cylinder in the unlocking state (the A-A section view of Embodiment II)

FIGS. 9 and 10 show Embodiment I of the lock cylinder in the locking/unlocking state (the A-A section view of Embodiment II). In operation, the labels and descriptions as set out for FIGS. 7 and 8 above similarly apply. The held or released lock pin 8 in the lock cylinder is similar to that disclosed in American U.S. Pat. No. 5,823,030 Cylinder Lock System and U.S. Pat. No. 6,155,089 Electromechanical Cylinder Lock. However, in contrast to the lock shown in FIGS. 7 and 8, the invention exhibits the following differences:

1. A circular locating hole (namely 3*b* in FIGS. 7 and 8) is drilled in the cylinder body 3, such that better detection of the unlocked or locked state relative to the reference position is facilitated;

2. The processing of the circular locating hole is easier than that of a V-shaped locating groove (namely 3*c* marked in FIG. 10) as recommended in the U.S. Pat. No. 5,823,030, with the added advantage that a lock pin with an arc sliding surface can be adapted for use with the V-shaped locating groove.

Figure 11:
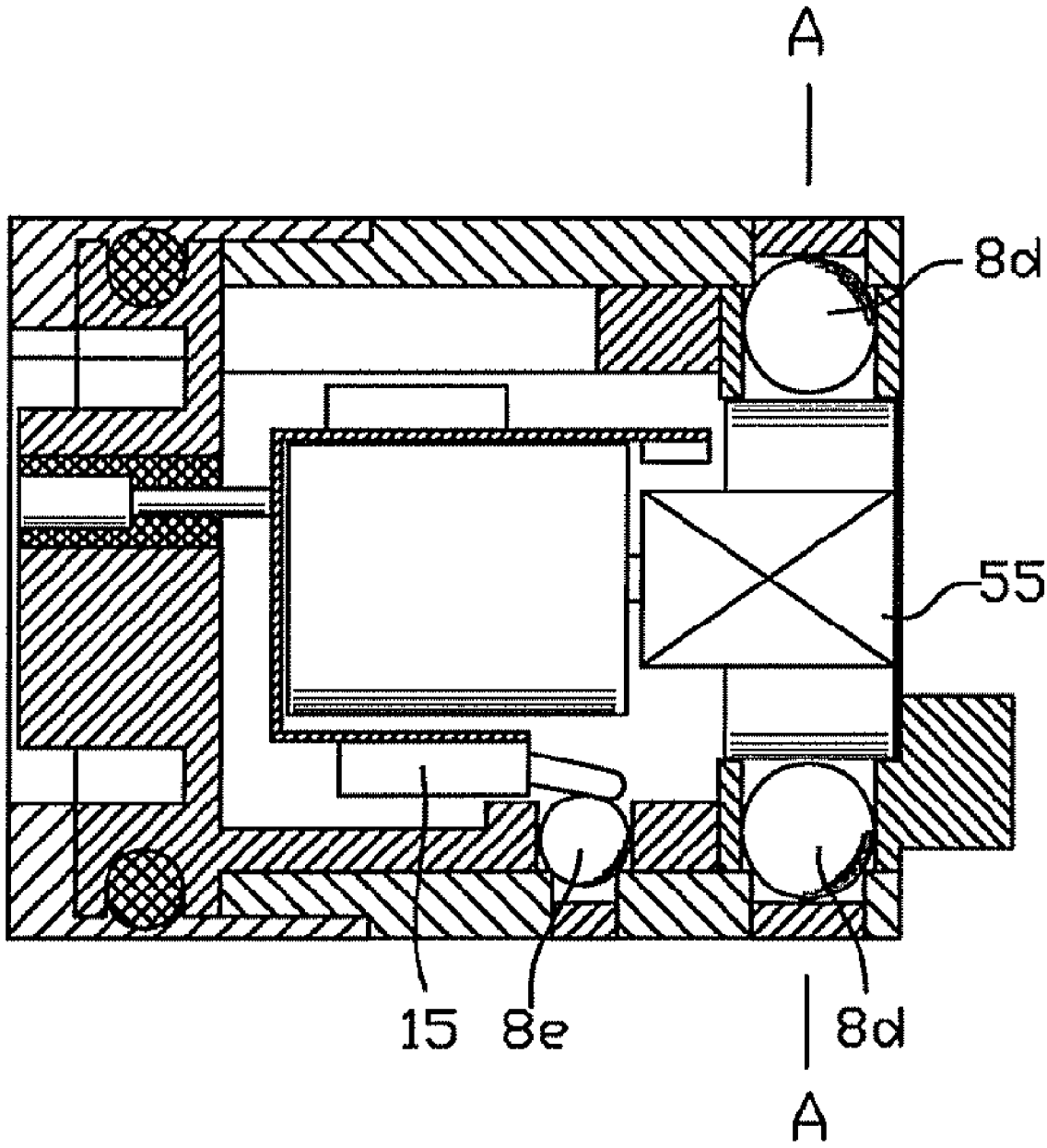
FIG. 11 shows a sectional view of Embodiment II of the lock cylinder (assembled)

FIG. 11 shows the sectional view of Embodiment II of the lock cylinder (assembled) in which the basic mechanism and operating principle is similar to that of Embodiment I, with the following differences: the lock pin 8 with an arm rod is replaced by one to two spherical lock pins 8*d*; a travel pin 8*e* is added to substitute the function of the arm rod on the lock pin 8, and thus, when the travel pin 8*e* and the lock pin 8*d* move synchronously and leave their respective locating holes, the travel pin 8*e* actuates the first locating switch 15; and the external diameter of a cam 55 is slightly greater than that of the cam 5 in Embodiment I.

Figure 12:
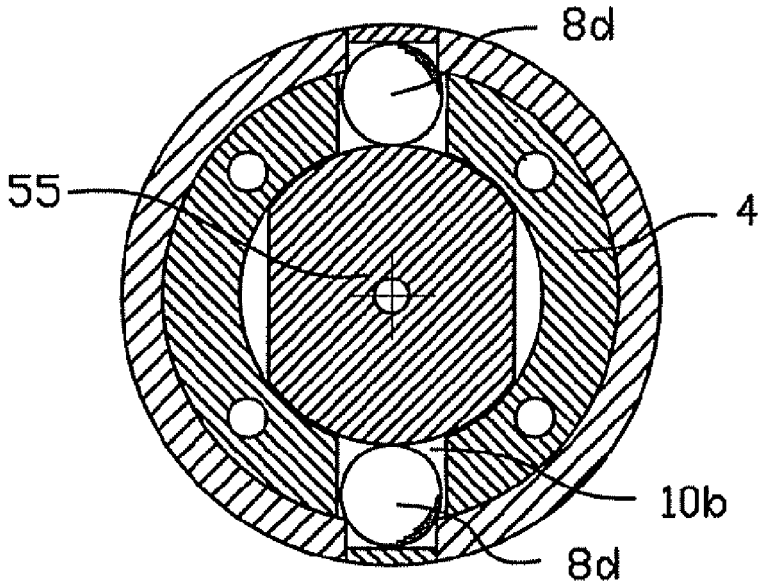
FIG. 12 shows Embodiment II of the lock cylinder in the locking state (namely the A-A section view of the cylinder in FIG. 11)

FIG. 12 shows Embodiment II of the lock cylinder in the locking state (namely the A-A section view) in which, when the cylinder is in the locking state, the relative positions of the following relevant mechanical parts and components are shown: the end cover 4, the displacement limiting cam 55 and the lock pin 8*d*. The lock pin 8*d* is located in the guide hole 10*b* of the end cover 4 and its movement is blocked by the convex surface of the displacement limiting cam 55. Thus, the lock pin 8*d* is prevented from moving when positioned between the rotatable plug and the immovable cylinder body.

Figure 13:
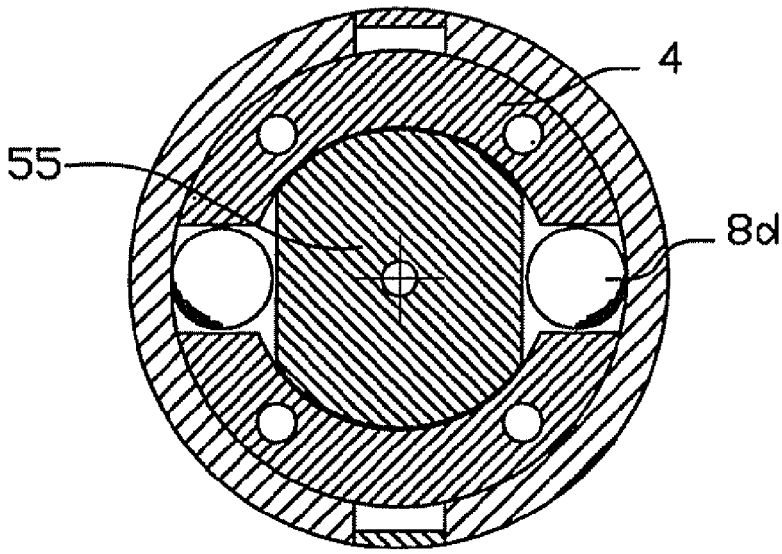
FIG. 13 shows Embodiment II of the lock cylinder in the unlocking state (namely the A-A section view of the cylinder in FIG. 11)

FIG. 13 shows Embodiment II of the lock cylinder in the unlocking state (namely the A-A section view) in which, when the cylinder is in unlocking state, the displacement limiting cam 55 is rotated by 90 degrees, followed by the rotation of the rotatable plug by 90 degrees. The relative positions of the following relevant mechanical parts and components are shown: the end cover 4, the displacement limiting cam 55 and the lock pin 8*d*.

FIG. 14 shows a circuit block diagram of a basic key and a lock cylinder in which the basic active electronic key circuit solution is shown in the left part of the figure, namely the disclosed technical solution of the patent ZL 99203695.X Key to Electronic Lock. A battery 51 and a crypto chip ID-52 in the key are respectively connected to three electrodes 25. When the three electrodes 25 of the key contact with the three electrodes 11 of the lock cylinder on the right side of the figure, electrical power of the key is supplied to the circuit in the lock cylinder and is simultaneously fed back to the crypto chip ID-52 in the key through a resistor R-53. Thus, the microcontroller unit MCU-55 reads the ID of the key through the data electrodes. When the ID setup in the MCU-55 is the same as the ID setup in the crypto chip 52 and the travel switch K1-15 is in the closed state, namely when the spherical surface of the lock pin projects into the locating hole of the cylinder body, the photoelectric reflecting type locating switch K2-16 detects the light-reflecting signal of the displacement limiting cam 5, the MCU-55 provides an unlocking instruction. The drive-IC57 actuates the stepping micromotor 14 to rotate 90 degrees such that the concave surface of the displacement limiting cam 5 is located opposite to the lock pin. The lock pin is released and allowed to move along an axial direction, so that the lock cylinder is in the unlocking state, and the rotatable plug is freely rotatable. When the K1-15 is closed, namely when the spherical surface of the lock pin projects into the locating hole of the cylinder body, a failure of K2-16 to detect the light-reflecting signal of the displacement limiting cam will result in the MCU-55 providing a locking instruction. The drive-IC57 then actuates the stepping micromotor 14 to rotate 90 degrees. Simultaneously, the convex surface of the displacement limiting cam, namely the part having the maximum diameter, blocks the movement of the lock pin so as to stop the lock pin moving along an axial direction. The lock plug therefore cannot rotate, and the lock cylinder is in the locking state. When K1-15 is in the opened state, the rotation of the lock plug is indicated such that the lock pin has emerged from the locating hole. The MCU-55 will therefore not provide an instruction to actuate the rotation of the stepping micromotor 14. A light emitting diode LED-54 can also be arranged in the lock cylinder to indicate the operating condition of the lock cylinder.

A crypto chip made by Dallas Semiconductor Incorporation (DALLAS brand) in the 1990s can be used as the crypto chip ID-52 referred in the embodiment, and is widely used for the 1-Wire series single-chip IC of electronic locks, such as DS1990 or DS1994 and the like. However, DS1990 only has a 64-bit ID, except for unlocking with cryptographic authentication, and other additional functions of the ID are simpler. In contrast, DS1994 not only has a 64-bit ID, but also comprises a real-time clock and an erasable memory having a function for storing the unlocking and locking time, the numbering data of the lock cylinder and the key, and the like over an extended period of time. A 8-bit microcontroller unit with an erasable data memory can also be used as the MCU-55 in the lock cylinder so as to record and store a plurality of related data, the data obtained through the key being readable by a computer system. The method of data writing and reading is described in more detail elsewhere.

Figure 15:
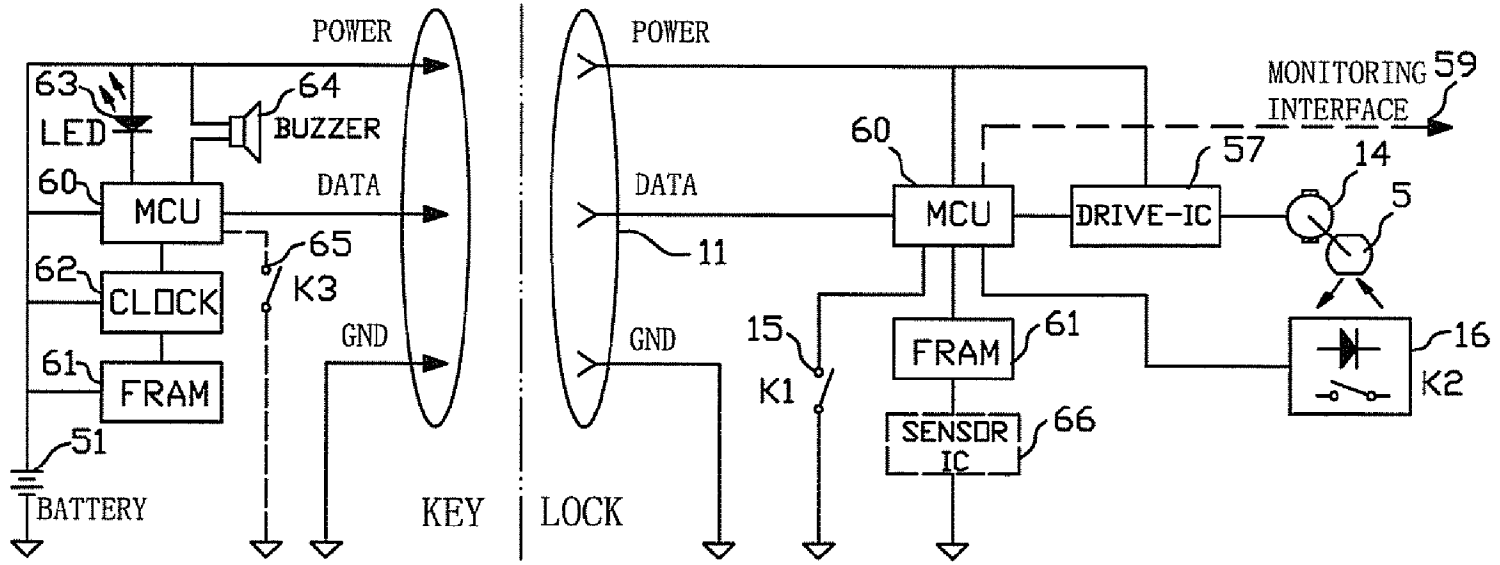
FIG. 15 shows a circuit block diagram of a key with MCU and a lock cylinder.

FIG. 15 shows a circuit block diagram of a key with MCU and a lock cylinder in which basic operation of the circuit is similar to that described in FIG. 14. Chips, such as a microcontroller unit MCU-60, a real-time clock 62, a ferromagnetic random access memory FRAM-61 and the like, can also be arranged in the key to typically form a small SCM (single-chip microcomputer) system so as to substitute for the multi-functional crypto single-chip ID-52 (DS1994) in FIG. 14. The system can set a password ID automatically, and except for the basic functions of recording and storing the unlocking and locking time and other related data, other additional functions can be also introduced into the system. The size of the FRAM-61 memory in both the key and the lock cylinder determines the data quantity of unlocking and locking records over time, the recorded data can also be read by a computer system, the LED-63 and a buzzer 64 are useful for prompting various executing states or functions. The switch K3-65 sets the unlocking or locking instruction of the key, and this function is necessary for controlling the lock cylinder which rotates for several rotations. If necessary a communication monitoring interface 59 can be used to connect the microcontroller unit MCU-60 in the lock cylinder to a wired/wireless communication network to produce a high-level active electronic lock, having intellectual functions of remote real-time monitoring and the like. A sensing element 66 can be selected for use as required, if detection of destructive external force impact information is required. An acceleration sensing chip can be selected for use, if detection of ambient temperature information is required. A temperature sensing chip and the like can be selected for use, and these sensing elements are connected with the MCU-60 in the lock cylinder for processing. The elements and devices in this figure are marked with the same labels as those of FIG. 14 and have the same functions. The basic composition and operating principle of the smallest SCM system comprising a few of ICs is set out above. If a single-chip MCU is integrated with a large-size erasable data memory and a real-time clock is used in the key and the lock cylinder, the circuit composition of the key and the lock cylinder are simplified. It will be appreciated that the elements and devices in the control circuit component can be combined in various ways, and practical functions can be appropriately added or reduced as required, but the basic structure and operating mode of the control circuit remains related to the disclosed technical solution of the patent ZL 99203695.X Key to Electronic Lock.

Figure 16:
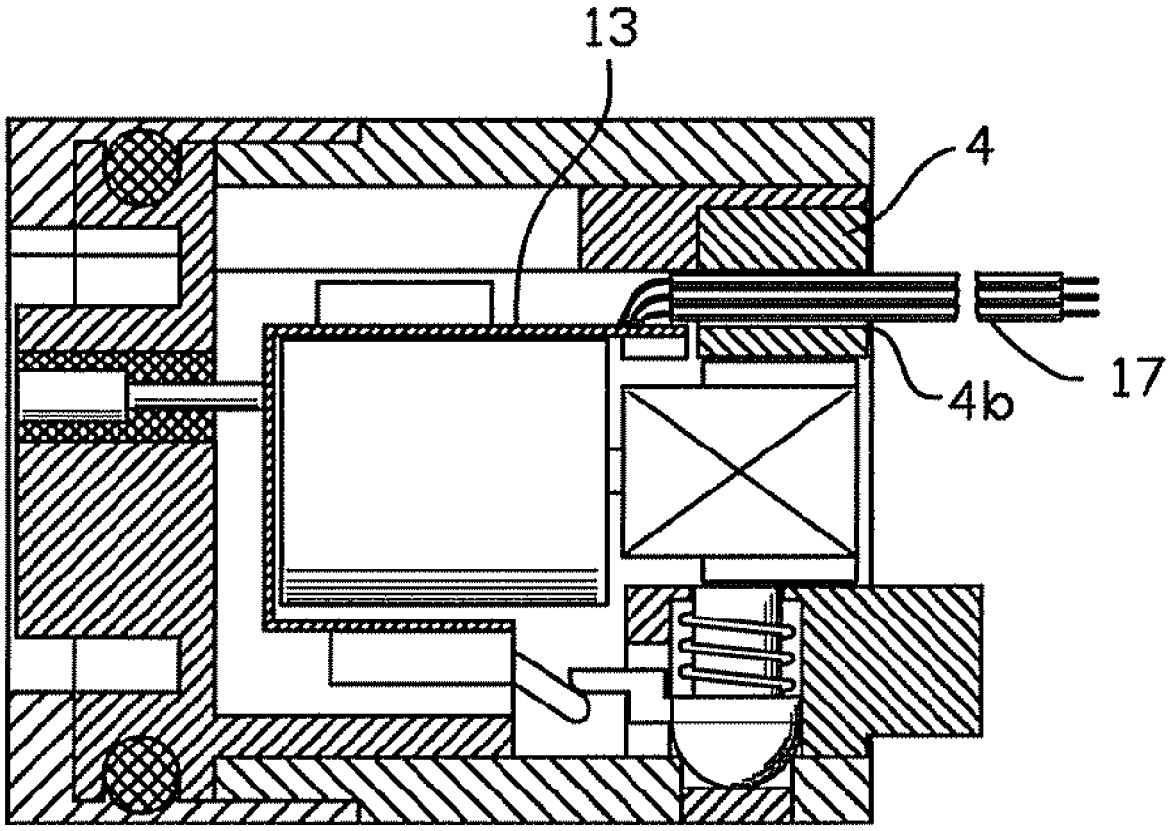
FIG. 16 shows a sectional view of a lock cylinder which can be connected with a network for monitoring.

FIG. 16 shows the sectional view of a lock cylinder which can be connected with a network for monitoring. A wire hole 4*b* is drilled in the end cover 4 and a conductor 17 for the networking monitoring interface is led from the electronic control circuit board 13 so as to separate monitoring or networking. High-level conventional functions of real-time remote monitoring as well as functions of dual control unlocking can be carried out. For example, unlocking can be centrally controlled through the network which is important to some applications (such as on fire). Also, when the network is frozen or nonfunctional, the active 'key to electronic lock' can still be used for unlocking. Because the micropower passive electronic lock cylinder has very low unlocking and locking power consumption, centralized remote unlocking can be carried out over a greater distance. The distributed half-centralization power supply type active electronic lock system is monitored by the network and when the network is at fault or interrupted from a power supply, the lock system cannot be unlocked by a passive IC card type electronic key unless a large number of distributed back-up batteries is allocated, making the system more complex and increasing maintenance cost which is not beneficial to the environment.

The use of a permanent magnet located in the marked position of the displacement limiting cam to drive a magnetic switch (such as Hall-effect switch, reed switch and the like), or a salient point formed on the marked position of the displacement limiting cam to drive the electromechanical switch is similar to that of a photoelectric reflecting type switch which used for obtaining switching information of a locating switch. Further details on the contents of software programming, data reading and writing, networking communication and circuit hardware structure of a signal-chip microcontroller unit and the operating principles of a stepping micromotor and a rotary solenoid are described in relevant textbooks for polytechnic school and technical literatures. The operating principles will be familiar to persons skilled in the fields of electronics, single-chip computer engineering and automatic control engineering and are not further described herein.

It will be appreciated that other electronic elements and devices without marked models in the embodiment of the invention can be the products of various brands and varieties which are sold in the existing market, and the invention is not restricted to such elements and devices.

Throughout the specification, unless the context requires otherwise, the word "comprise" or variations such as "comprises" or "comprising", will be understood to imply the inclusion of a stated integer or group of integers but not the exclusion of any other integer or group of integers.

Each document, reference, patent application or patent cited in this text is expressly incorporated herein in their entirely by reference, which means that it should be read and considered by the reader as part of this text. That the document, reference, patent application, or patent cited in this text is not repeated in this text is merely for reasons of conciseness.

Reference to cited material or information contained in the text should not be understood as a concession that the material or information was part of the common general knowledge or was known in the United States or any other country.

What is claimed is:

1. A micropower passive electronic lock cylinder, comprising:

a cylinder body;

a rotatable plug;

an electronic control circuit; and a micromotor or a rotary solenoid electrically connected with the electronic control circuit wherein the electronic control circuit and either the micromotor or rotary solenoid are arranged in the rotatable plug;

the micromotor or rotary solenoid being adapted to drive a displacement limiting cam to rotate; and the electronic control circuit being adapted to instruct the displacement limiting cam to rotate to a position in which a lock pin is limited or released, such that a locking or unlocking state of the rotatable plug is controlled.

2. The micropower passive electronic lock cylinder according to claim 1 wherein the displacement limiting cam comprises at least one external convex surface, and when the displacement limiting cam rotates one circle, the at least one external convex surface of the displacement limiting cam is opposite to the lock pin and prevents the lock pin from moving.

3. The micropower passive electronic lock cylinder according to claim 1 wherein the displacement limiting cam comprises at least one external concave surface, and when the displacement limiting cam rotates one circle, the at least one external concave surface of the displacement limiting cam is opposite to the lock pin to release the lock pin to move.

4. The micropower passive electronic lock cylinder according to claim 1 wherein a first locating switch which is electrically connected with the electronic control circuit is arranged beside the lock pin or a travel pin; and the lock pin or the travel pin moves to drive the first locating switch so that switching information of a position is obtained, the switching information being processed by the electronic control circuit.

5. The micropower passive electronic lock cylinder according to claim 1 wherein the displacement limiting cam comprises at least one light-reflecting surface or permanent magnet or salient point; the electronic control circuit is electrically connected with a photoelectric reflecting type second locating switch or magnetic-control locating switch or electromechanical locating switch; and when the light-reflecting surface is opposite to the photoelectric reflecting type second locating switch, or the permanent magnet is opposite to the magnetic-control locating switch, or the salient point is opposite to the electromechanical locating switch, switching information of a position is obtained, the switching information being processed by the electronic control circuit.

6. The micropower passive electronic lock cylinder according to claim 2 wherein the lock pin comprises a lower spherical surface or sliding surface and when the lock pin moves or is blocked by the at least one external convex surface, a part of the lower spherical surface or sliding surface of the lock pin is projectable into a corresponding locating hole of the cylinder body.

7. The micropower passive electronic lock cylinder according to claim 1, 2 or 3 wherein the lock pin comprises at least one spherical surface.

8. The micropower passive electronic lock cylinder according to claim 1 wherein the electronic control circuit is electrically connectable with a conductor which is led from a tail end of the rotatable plug and is used for connecting with an external control circuit or network.

9. The micropower passive electronic lock cylinder according to claim 1 wherein the electronic control circuit is electrically connectable to sensing elements and devices for sensing and processing information from a surrounding environment.

10. The micropower passive electronic lock cylinder according to claim 1 wherein the electronic control circuit is a flexible printed circuit.

11. The micropower passive electronic lock cylinder according to claim 10, wherein the electronic control circuit is a flexible printed circuit arranged in a finite space in the rotatable plug.

* * * * *